United States Patent [19]

Dzaack et al.

[11] 3,931,495

[45] Jan. 6, 1976

[54] ELECTRIC HEATING UNITS

[75] Inventors: Walter J. Dzaack, Glenshaw; Donald M. Cunningham, Pittsburgh; Frank T. Walton, Oakmont, all of Pa.

[73] Assignee: Emerson Electric Co., St. Louis, Mo.

[22] Filed: Dec. 11, 1974

[21] Appl. No.: 531,665

[52] U.S. Cl. ..... 219/463; 219/404; 219/451; 219/467

[51] Int. Cl.[2] ..... H05B 3/68

[58] Field of Search ..... 219/403, 404, 447, 451, 219/463, 467, 536, 537

[56] References Cited

UNITED STATES PATENTS

| | | | |
|---|---|---|---|
| 2,835,780 | 5/1958 | Bremer | 219/451 |
| 3,118,124 | 1/1964 | Bleckmann | 219/536 X |
| 3,172,995 | 3/1965 | Kirschke et al. | 219/453 |
| 3,213,266 | 10/1965 | Kirschke | 219/451 |
| 3,482,079 | 12/1969 | Hurko | 219/463 |
| 3,525,849 | 8/1970 | Bleckmann | 219/536 X |

FOREIGN PATENTS OR APPLICATIONS

| | | | |
|---|---|---|---|
| 961,355 | 6/1964 | United Kingdom | 219/451 |
| 1,110,737 | 4/1968 | United Kingdom | 219/463 |
| 1,273,771 | 7/1968 | Germany | 219/463 |

*Primary Examiner*—Volodymyr Y. Mayewsky
*Attorney, Agent, or Firm*—Michael Williams

[57] ABSTRACT

The heating unit is particularly adapted for a stove panel and the like, and comprises a pan adapted to be supported on the panel, the pan having an opening in its side wall. A sheathed electric heating element has an active heating portion formed into a flat spiral, such heating portion being supported crosswise of the top of the pan. The heating element has at least two terminal portions extending downwardly from the active heating portion and laterally thereof, the terminal portions extending through the pan opening for connection to a source of electrical energy. A closure, formed of an elastic material, such as cured silicone rubber, closes the pan opening. The terminal portions extend through the closure and the latter cooperates with the terminal portions to provide a hinge about which the heating element may be pivoted to swing the active heating portions upwardly from its supported position on the top of the pan.

9 Claims, 6 Drawing Figures

ELECTRIC HEATING UNITS

BACKGROUND AND SUMMARY

It is an object of our invention to provide a cook-top surface unit of the hinged type wherein the terminals of the unit are sealed from contact with any fluid which may be spilled onto the unit and collected in the pan therebeneath. U.S. Pat. No. 3 213 266, issued Oct. 19, 1965, to Norman W. Kirschke, discloses a unit of this type; however, this patent utilizes a separate mechanical hinge in conjunction with a flexible sealing boot, whereas in use of our invention, the separate mechanical hinge is eliminated. German Pat. No. 1 236 100 utilizes a bellows-type seal which has limited advantages.

Our invention provides a closure for an opening in the side wall of the pan which supports the heating element, the closure being formed of material of an elastic nature. The terminal portions of the heating element pass through the closure and the latter provides a hinge that will permit the heating element to be pivoted to and from a horizontal position so that the pan therebeneath may be cleaned. The closure may be formed of any suitable material that will withstand the temperature in the terminal portion area of the heating element and will distort without losing sealing engagement with the terminal portions and the wall portion of the pan margining the pan opening. Thus, the closure acts not only as a means for sealing the terminals of the heating element from liquid that may be spilled on the latter, but also acts as a hinge for the heating element.

DESCRIPTION OF THE DRAWINGS

In the drawings accompanying this specification and forming a part of this application, there is shown an embodiment which our invention may assume, and in these drawings.

DESCRIPTION OF THE PREFERRED EMBODIMENT

Figures 1, 2, 3:
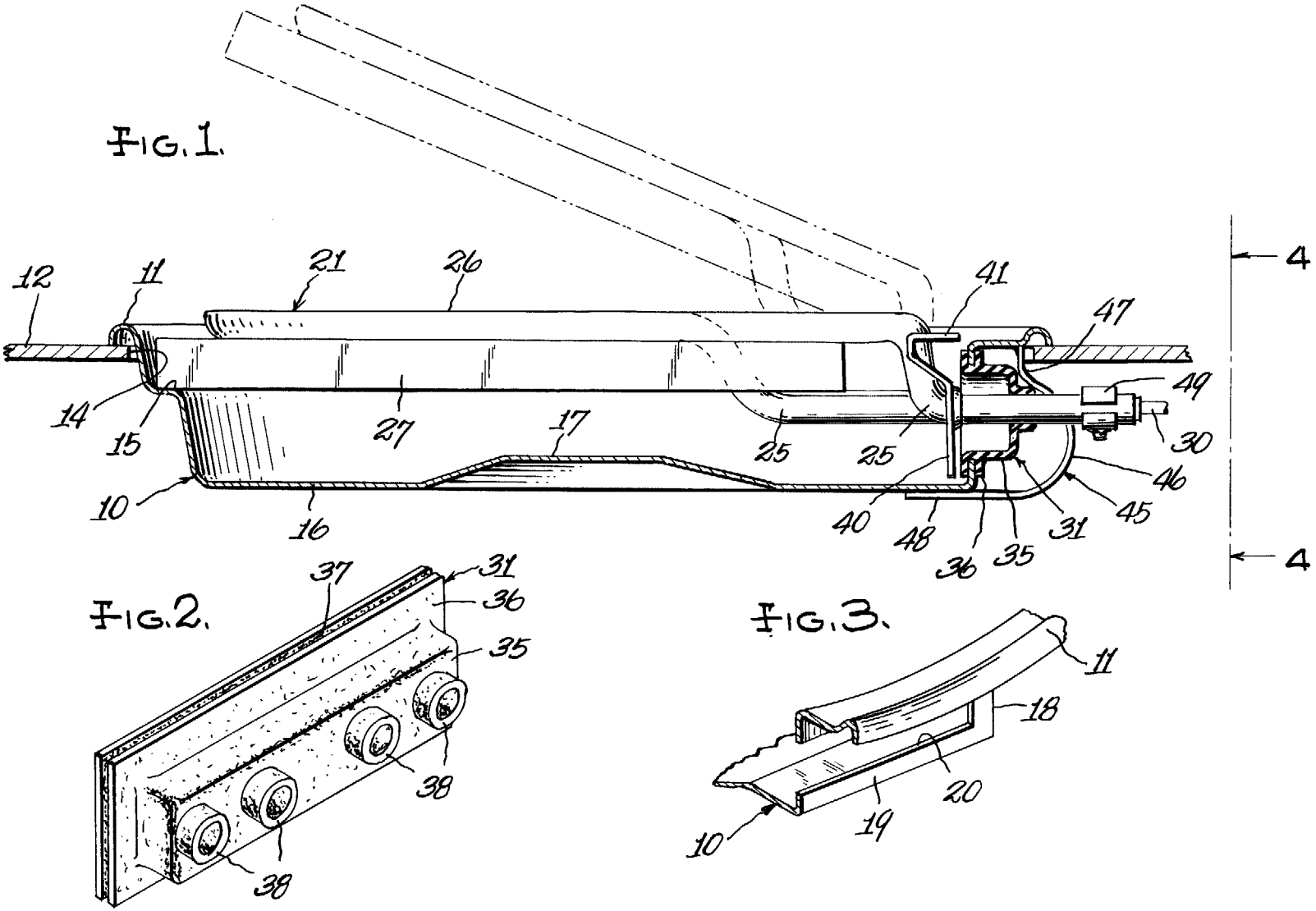
FIG. 1 is a vertical sectional view of a heating element construction, parts being shown in elevation.
FIG. 2 is a perspective view of the closure which is shown in section in FIG. 1.
FIG. 3 is a fragmentary perspective view of a portion of the supporting pan.
Figure 4:
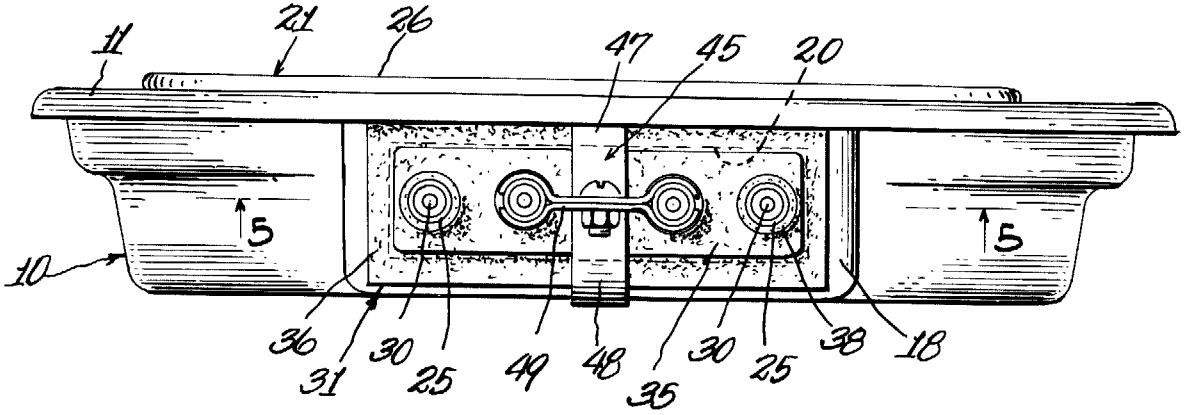
FIG. 4 is a side elevational view looking in the direction of the line 4—4 of FIG. 1.
Figure 6:
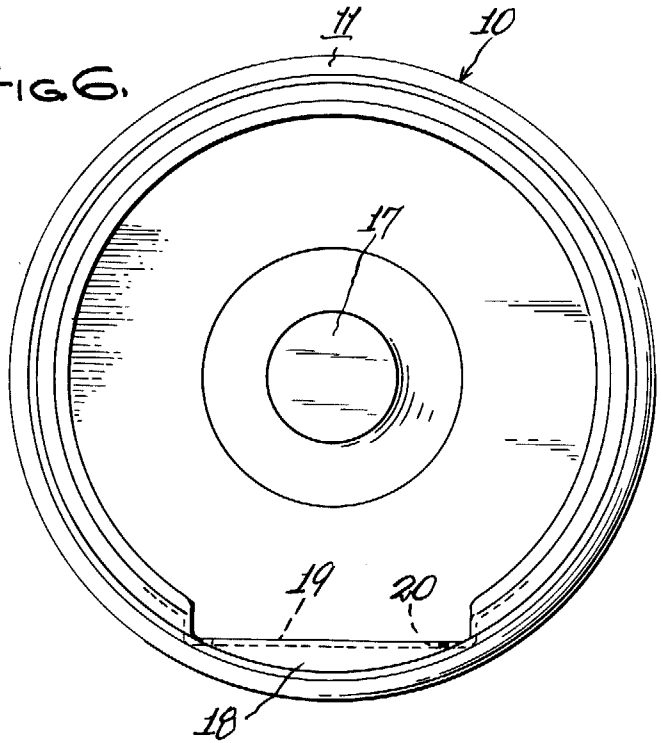
FIG. 6 is a top plan view, drawn to a reduced scale, and looking down into the supporting pan.

Referring to FIG. 1, the pan 10 has an annular upper bead 11 which rests on a panel 12, such as the top panel of a stove. The panel has an opening 14 and the pan extends therethrough so that a major portion is disposed below the panel. The pan has a ledge 15 and a bottom wall 16 which, in the illustrated embodiment, forms a complete bottom closure for the pan. If desired, the bottom wall may have a central, slightly raised portion 17. At a peripheral side portion, the pan is provided with a box-like formation 18 to provide a plane, vertically extending wall 19 which has a rectangular opening 20 formed therein.

The electric heating element 21 is not disclosed in detail since it may take the form of any well-known sheathed elements having at least two terminal portions. Attention is directed to U.S. Pat. No. 3 336 466, wherein a single coil sheathed element is disclosed having an active heating portion formed into a flat spiral, with two terminal portions extending downwardly therefrom and laterally thereof. In the embodiment herein disclosed, the heating element is in the form of a double, interlaced coil type, having four terminal portions 25 extending downwardly and laterally of the flat spiralled active heating portion 26. A heating element of this type is shown in U.S. Pat. No. 3 183 340.

The active heating portion 26 of the heating element 21 is supported on the pan ledge 15, such as by means of the usual spider 27 of a type such as disclosed in the aforesaid patents. In the disclosed embodiment, the spider is connected to the heating element in any suitable manner, such as suggested in U.S. Pat. No. 3 183 340. Or, the heating element may merely rest on the spider and otherwise have no connection therewith.

As seen in FIG. 1, the terminal portions 25 extend through the pan opening and have terminal pins 30 disposed exteriorly of the pan for connection to a suitable source of electrical energy.

An elastic, non-metallic closure 31 is disposed to close the pan opening and to cooperate with the terminal portions 25 to provide a hinge about which the heating element may be pivoted to swing the active heating portion to a raised position shown in dot-dash lines in FIG. 1. In the illustrated embodiment, the spider 27 moves with the heating element and the latter may be raised sufficiently so that the interior of the pan 10 is accessible for cleaning purposes.

Any suitable flexible material may be used to form the closure, such as a flexible, high-temperature thermoplastic. In the present embodiment, the closure is formed of cured, silicone rubber, and molded to the form shown in FIG. 2, to provide a hollow, elongated body 35 having a skirt wall 36 extending peripherally therefrom. As suggested in FIGS. 1 and 5, the skirt wall is of a peripheral size which is greater than the size of the pan opening 20. The wall has a peripherally extending recess 37 to closely receive the pan wall margining the opening. If desired, a suitable cement may be used to hold the skirt wall 36 to the pan wall and such cement may be a room temperature vulcanizing silicone rubber, such as Silastic RTV.

The hollow 35 is provided with integral tubular bosses 38 through which respective terminal portions 25 of the heating element extend in close-fitting relationship. Here, again, a suitable cement may be used, if found necessary. To maintain alignment of the terminal portions 25 in predetermined relationship, a metal cross-member 40 extends cross-wise of all terminal portions and has openings which closely receive the terminal portions and maintain them in lateral alignment. The upper portion of the member 40 may have a horizontally extending ledge 41 (see FIG. 1) to serve as a drip shield.

It will be appreciated that the closure 31 will be distorted from the shape shown in FIG. 1, when the heating element 21 is raised, and that the hollow body 35 will provide for such distortion without affecting the seal between the closure and the pan, or the closure and the terminal portions. Tests have been conducted wherein the pan was filled with water with the heating element in any of its positions and no leakage was detected.

Figure 5:
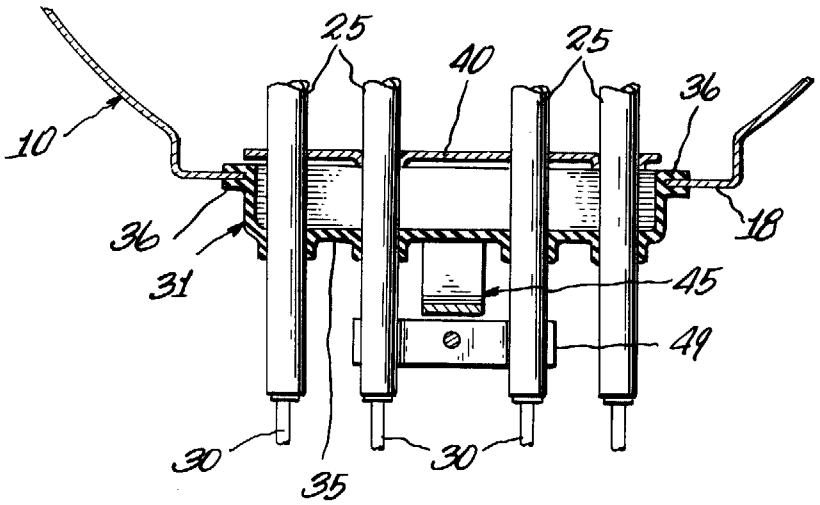
FIG. 5 is a fragmentary horizontal sectional view corresponding to the line 5—5 of FIG. 4.

In order to relieve the closure 31 from any abnormal flexing action, such as generated if the heating element were forcibly pulled to the left (FIG. 1) when in raised position, the pan and terminal portions are provided with interengaging means to prevent such abnormal flexing action. In the disclosed embodiment, a metal strip 45 is provided, having an intermediate curved portion 46 and end portions 47 and 48. The strip is disposed between the two innermost terminal portions 25, as seen in FIG. 5, and has its end portions 47–48 respectively, welded to spaced parts of the pan. A clip 49 is secured across the two innermost terminal portions and is in position to abut the curved strip portion 45 to limit movement of the heating element to the left, as viewed in FIG. 1.

We claim:

1. An electric heating unit for a stove panel and the like, comprising:

a pan adapted to be supported on the stove panel, said pan having an opening in its side wall, a sheathed electric heating element having a flat active heating portion supported crosswise of the top of said pan, said element having at least two terminal portions extending downwardly from said active heating portion and laterally thereof and extending through said pan opening for connection to a source of electrical energy, and an elastomeric closure connected to said pan around said pan opening and around the sheath of each terminal portion, said closure closing and sealing said pan opening, said terminal portions extending through said closure in sealed relation and the latter cooperating with said terminal portions to provide the sole hinge about which said heating element may be pivoted to swing said active heating portion upwardly from its supported position on the top of said pan, said closure providing the sole support for the heating element in its upward position.

2. The construction according to claim 1, wherein said closure is distorted during hinging action of said active heating portion, without affecting its connections with said pan and said terminal portions.

3. The construction according to claim 1, wherein said closure is a preformed molded product.

4. The construction according to claim 3 wherein said closure comprises a hollow body having openings therein through which respective terminal portions closely extend, and a wall skirting said hollow body and of a peripheral size to close said pan opening.

5. The construction according to claim 4 wherein said skirt wall has a peripherally extending marginal recess for closely receiving the wall of said pan margining its opening.

6. The construction according to claim 2 wherein said pan and said terminal portions have interengaging means to relieve said hinge of stresses which may be applied to tend to disconnect said closure from said pan.

7. The construction according to claim 5 wherein said hollow portion has an integral collar surrounding each opening therein to closely fit around respective terminal portions.

8. An electric heating unit for a stove panel and the like, comprising:

a pan adapted to be supported on the stove panel, said pan having an opening in its side wall, a sheathed electric heating element having a flat active heating portion supported crosswise of the top of said pan, said element having at least two terminal portions extending downwardly from said active heating portion and laterally thereof and extending through said pan opening for connection to a source of electrical energy, and a closure formed of an elastomeric material, comprising a normally rectangular hollow box-like body having opposite side and end walls and a wall spanning such walls, and a skirt wall at the opening into said body extending laterally outwardly of said side and end walls and of a peripheral size larger than the size of said pan opening, said skirt wall being secured to said pan side wall to close said opening, said spanning wall having openings therein to tightly pass respective terminal portions, said box-like body and said terminal portions cooperating to provide a hinge about which said heating element may be pivoted to swing said active portion upwardly from its supported position on the top of said pan, said box-like body distorting from its normal rectangular box-like formation to effect hinging action and resiliently returning to its normal formation when said heating element is returned to supported position on the top of said pan.

9. The construction according to claim 8 wherein said skirt wall has a peripheral recess for closely receiving the wall of said pan margining its opening.

* * * * *